US009718600B2

(12) United States Patent
Jian et al.

(10) Patent No.: US 9,718,600 B2
(45) Date of Patent: Aug. 1, 2017

(54) HEATABLE PACKAGE BAG

(75) Inventors: Bo-Xin Jian, New Taipei (TW); Yaw-Shin Liao, New Taipei (TW); Kao-Hsiung Liao, New Taipei (TW)

(73) Assignees: AIR-BAG PACKING CO., LTD., New Taipei (TW); Yaw-Shin Liao, New Taipei (TW)

( * ) Notice: Subject to any disclaimer, the term of this patent is extended or adjusted under 35 U.S.C. 154(b) by 359 days.

(21) Appl. No.: 13/307,535

(22) Filed: Nov. 30, 2011

(65) Prior Publication Data

US 2013/0077895 A1 Mar. 28, 2013

(30) Foreign Application Priority Data

Sep. 28, 2011 (TW) ..... 100135055 A

(51) Int. Cl.

| | |
|---|---|
| ***B65D 81/34*** | (2006.01) |
| ***B65D 33/01*** | (2006.01) |
| ***B65D 33/00*** | (2006.01) |
| ***B65D 77/22*** | (2006.01) |
| *B65D 33/25* | (2006.01) |

(52) U.S. Cl.

CPC ..... *B65D 81/3461* (2013.01); *B65D 33/007* (2013.01); *B65D 33/01* (2013.01); *B65D 77/225* (2013.01); *B65D 33/2508* (2013.01); *B65D 2205/00* (2013.01); *B65D 2205/02* (2013.01); *Y10T 156/1056* (2015.01); *Y10T 156/1057* (2015.01)

(58) Field of Classification Search

CPC .. B65D 33/01; B65D 77/225; B65D 81/2038; B65D 81/34; B65D 81/3407; B65D 81/3415; B65D 81/343; B65D 81/3438; B65D 81/3446; B65D 81/3453; B65D 81/3461; B65D 2205/00; B65D 2205/02; A61F 7/08

USPC ..... 383/45, 105, 100–103, 207, 208; 219/725, 727, 730, 731; 220/580, 202, 220/203.01, 203.08

See application file for complete search history.

(56) References Cited

U.S. PATENT DOCUMENTS

| | | | | |
|---|---|---|---|---|
| 3,625,351 A * | 12/1971 | Eisenberg | A61L 2/26 206/484 |
| 4,953,550 A * | 9/1990 | Dunshee | 607/114 |
| 5,804,265 A * | 9/1998 | Saad et al. | 428/35.2 |
| 6,010,244 A * | 1/2000 | Dobreski et al. | 383/63 |

(Continued)

*Primary Examiner* — Jes F Pascua
*Assistant Examiner* — Nina Attel
(74) *Attorney, Agent, or Firm* — Hauptman Ham, LLP

(57) ABSTRACT

A heatable package bag includes two sheets of outer film, a plurality of projections, a plurality of guiding channels and a plurality of pre-breakage portions, where the two sheets of outer film includes a plurality of inner surfaces, a storage space is formed among the plurality of inner surfaces, adapted to receive an article; the plurality of projections is positioned on the plurality of inner surfaces, adapted to support the surface of the article; the guiding channels are positioned among the projections, the air in the storage space flows along the guiding channels; and the pre-breakage portions are positioned on the guiding channels. The air in the storage space is expanded to compress the two sheets of outer film during heating, and the plurality of pre-breakage portions is broken, allowing the air to flow out of the storage space via the plurality of pre-breakage portions.

20 Claims, 8 Drawing Sheets

(56) References Cited

U.S. PATENT DOCUMENTS

| | | | | |
|---|---|---|---|---|
| 6,068,898 | A * | 5/2000 | Oyama | 428/35.2 |
| 7,399,263 | B2 * | 7/2008 | Hartman et al. | 493/213 |
| 7,438,473 | B2 * | 10/2008 | Borchardt | 383/103 |
| 7,726,880 | B2 * | 6/2010 | Zimmerman et al. | 383/103 |
| 7,857,514 | B2 * | 12/2010 | Gaikwad et al. | 383/59 |
| 8,197,139 | B2 * | 6/2012 | Turvey et al. | 383/103 |
| 2002/0110290 | A1 * | 8/2002 | Gebhardt | 383/103 |
| 2002/0147091 | A1 * | 10/2002 | Healy et al. | 493/213 |
| 2004/0103989 | A1 * | 6/2004 | Lin | 156/309.6 |
| 2006/0280388 | A1 * | 12/2006 | Zimmerman et al. | 383/44 |
| 2006/0280389 | A1 * | 12/2006 | Zimmerman et al. | 383/44 |
| 2009/0154846 | A1 * | 6/2009 | Buchman et al. | 383/103 |
| 2009/0190861 | A1 * | 7/2009 | Turvey et al. | 383/45 |
| 2009/0200294 | A1 * | 8/2009 | Harl et al. | 219/730 |
| 2009/0238497 | A1 * | 9/2009 | Liao et al. | 383/103 |
| 2009/0301034 | A1 * | 12/2009 | Abraham et al. | 53/434 |
| 2009/0302032 | A1 * | 12/2009 | Middleton | 219/730 |
| 2010/0025392 | A1 * | 2/2010 | Nishi | B65D 81/3461 219/725 |
| 2010/0129503 | A1 * | 5/2010 | Flaherty | 426/234 |
| 2012/0012578 | A1 * | 1/2012 | Hach | 219/730 |

* cited by examiner

HEATABLE PACKAGE BAG

CROSS-REFERENCES TO RELATED APPLICATIONS

This non-provisional application claims priority under 35 U.S.C. §119 (a) on Patent Application No(s). 100135055 filed in Taiwan, R.O.C. on Sep. 28, 2011, the entire contents of which are hereby incorporated by reference.

TECHNICAL FIELD

The present invention relates to a package bag structure, and more particularly to a heatable package bag.

BACKGROUND

A diet of convenience food is popular among modern busy-working people, such that the food market is flooded with prepared food packages containing vegetable, seafood or meat. Prepared food packages are unfrozen and heated in a microwave oven before eating, and can be eaten in a very short time.

However, prepared food packages or other hermetically sealed food packages available in markets are made mostly of plastic films with low air permeability. As a result, the temperature and pressure of the air in the sealed package will be increased quickly, leading to bursting, which may damage the package during the heating of a microwave oven if the air permeation of the plastic film is insufficient and its critical tensile strength is reached.

To solve this problem, a user usually cuts an opening or poke a hole at one end of a package bag, allowing high-pressure and high-temperature air to escape through the opening or hole during the heating of the micro oven, thereby preventing internal pressure in the package from increasing suddenly to bursting point.

SUMMARY

In view of this problem, the present invention proposes a heatable package bag, including: two sheets of outer film, including a plurality of inner surfaces, a storage space used for receiving an article being formed among the plurality of inner surfaces; a plurality of projections used for supporting a surface of the article, positioned on the plurality of inner surfaces and projected out of the plurality of inner surfaces; a plurality of guiding channels, positioned among the plurality of projections of the plurality of inner surface, air in the storage space flowing along the plurality of guiding channels; and a plurality of pre-breakage portions, positioned on the plurality of guiding channels of the plurality of inner surfaces, air in the storage space being expanded during heating to press the two sheets of outer film, breaking the plurality of pre-breakage portions, thereby allowing the air to flow out of the storage space via the plurality of pre-breakage portions.

The present invention also proposes a method for making a heatable package bag, including: providing two sheets of outer film, the two sheets of outer film including a plurality of inner surfaces; configuring a plurality of projections on at least one of the plurality of inner surfaces, and forming a plurality of guiding channels among the plurality of projections; adhering circumferences of the two sheets of outer film to each other by means of hot sealing to form a storage space among the plurality of inner surfaces, and spot-hitting at least one of the plurality of inner surfaces to for a plurality of pre-breakage portions on the plurality of inner channels, where air in the storage space is expanded during heating to press the two sheets of outer film after the storage space is sealed, breaking the plurality of pre-breakage portions to allow the air to flow out of the storage space via the plurality of pre-breakage portions.

The present invention also proposes a method for making a heatable package bag, including: providing two sheets of outer film, the two sheets of outer film including a plurality of inner surfaces; spot-hitting at least one of the plurality of inner surfaces to form a plurality of pre-breakage portions; adhering the two sheets of outer film to each other by means of hot sealing to form a plurality of projections on at least one of the plurality of inner surfaces, and forming a plurality of guiding channels among the plurality of projections, where the plurality of pre-breakage portions on the plurality of projections is eliminated by hot press; and adhering circumferences of the two sheets of inner film to each other by means of hot sealing to form a storage space among the plurality of inner surfaces, where air in the storage space is expanded during heating to press the two sheets of outer film after the storage space is sealed, breaking the plurality of pre-breakage portions to allow the air to flow out of the storage space via the plurality of pre-breakage portions.

According to the present invention, the plurality of projections is disposed on the inner surfaces of the package bag, adapted to prevent an article from attaching closely to the outer film to affect the heating efficiency. In addition, the plurality of guiding channels is formed among the plurality of projections according to the present invention, guiding air flow, allowing the article to be heated uniformly, thereby increasing the heating effect. Furthermore, since the plurality of pre-breakage portions is disposed on the plurality of guiding channels according to the present invention, the plurality of pre-breakage portions is broken to allow air to flow out of the storage space via the plurality of pre-breakage portions when the air is heated to expand to press the two sheets of outer film, thereby avoiding bursting and damage to the package effectively, and solving the inconvenience in the prior art, caused by the necessity of cutting an opening or poking a hole in advance.

BRIEF DESCRIPTION OF THE DRAWINGS

The present invention can be more fully understood by reference to the following description and accompanying drawings, wherein.

DETAILED DESCRIPTION

Figure 1:
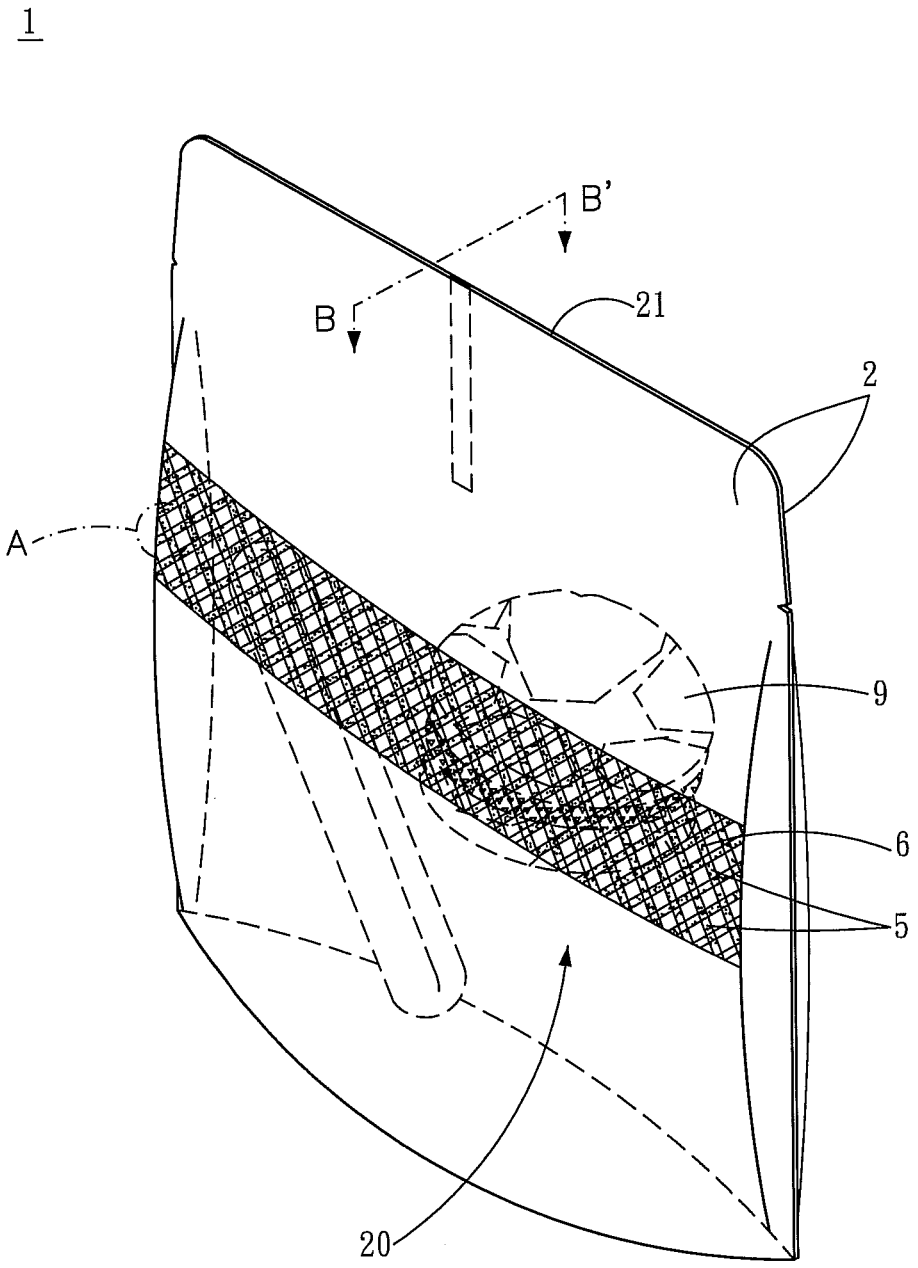
FIG. 1 is a schematically perspective view of a first preferred embodiment according to the present invention.
Figure 2:
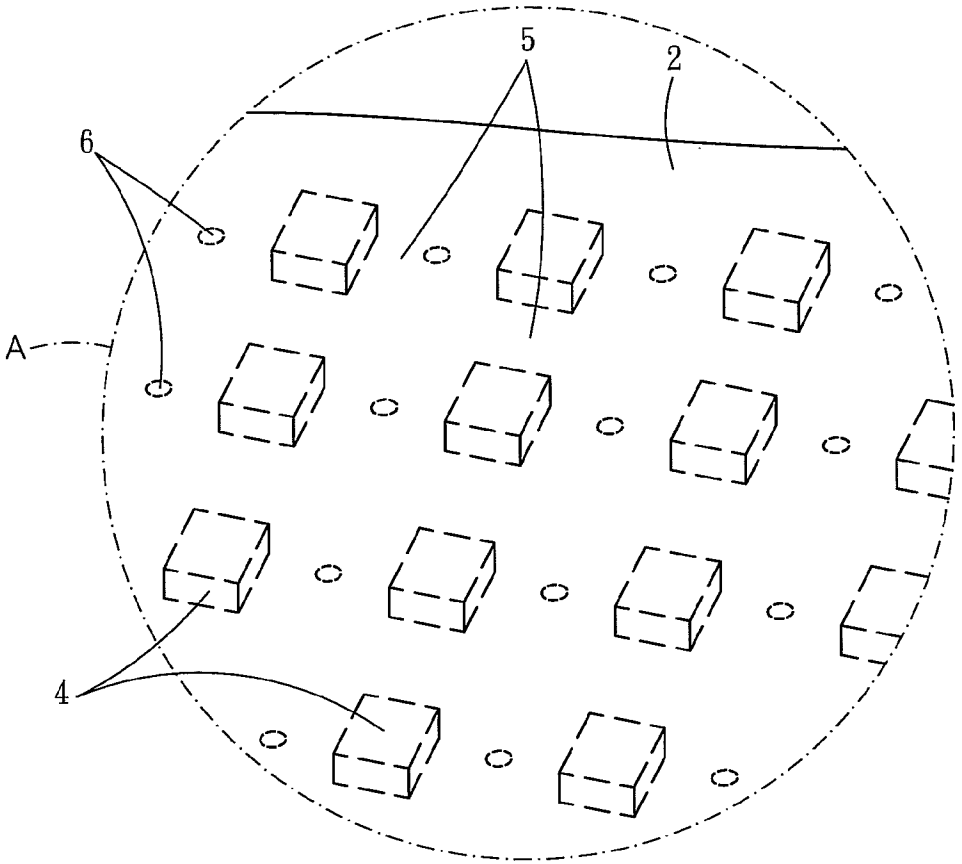
FIG. 2 is a schematically partly enlarged view of a portion A shown in FIG. 1.
Figure 3:
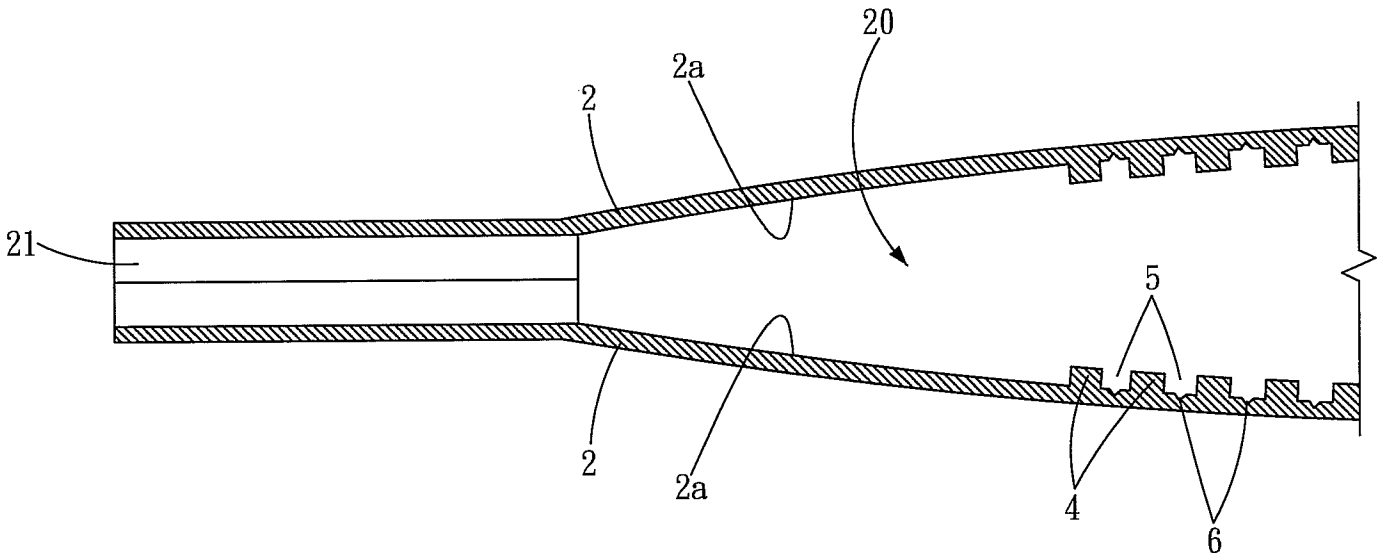
FIG. 3 is a schematically cross sectional view taken along line B-B' of FIG. 1.
Figure 4:
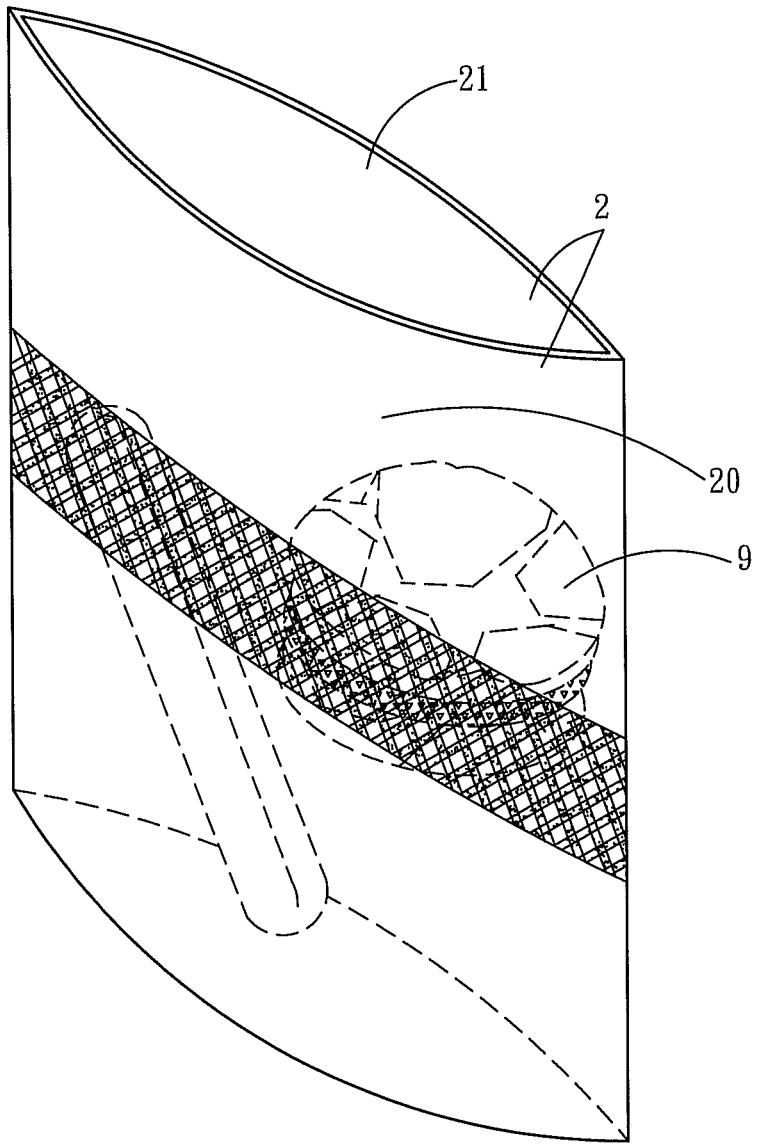
FIG. 4 is a schematically perspective view of the first embodiment according to the present invention while being in use.
Figure 5:
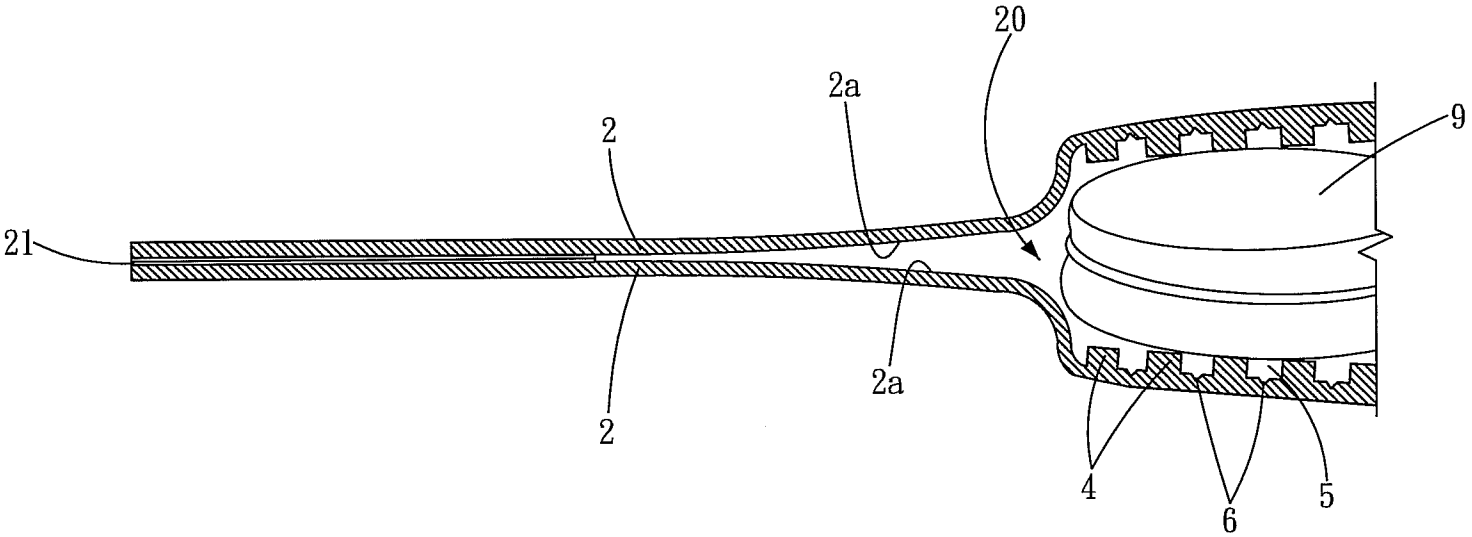
FIG. 5 is a laterally cross sectional view of the first embodiment according to the present invention while being in use.
Figure 6:
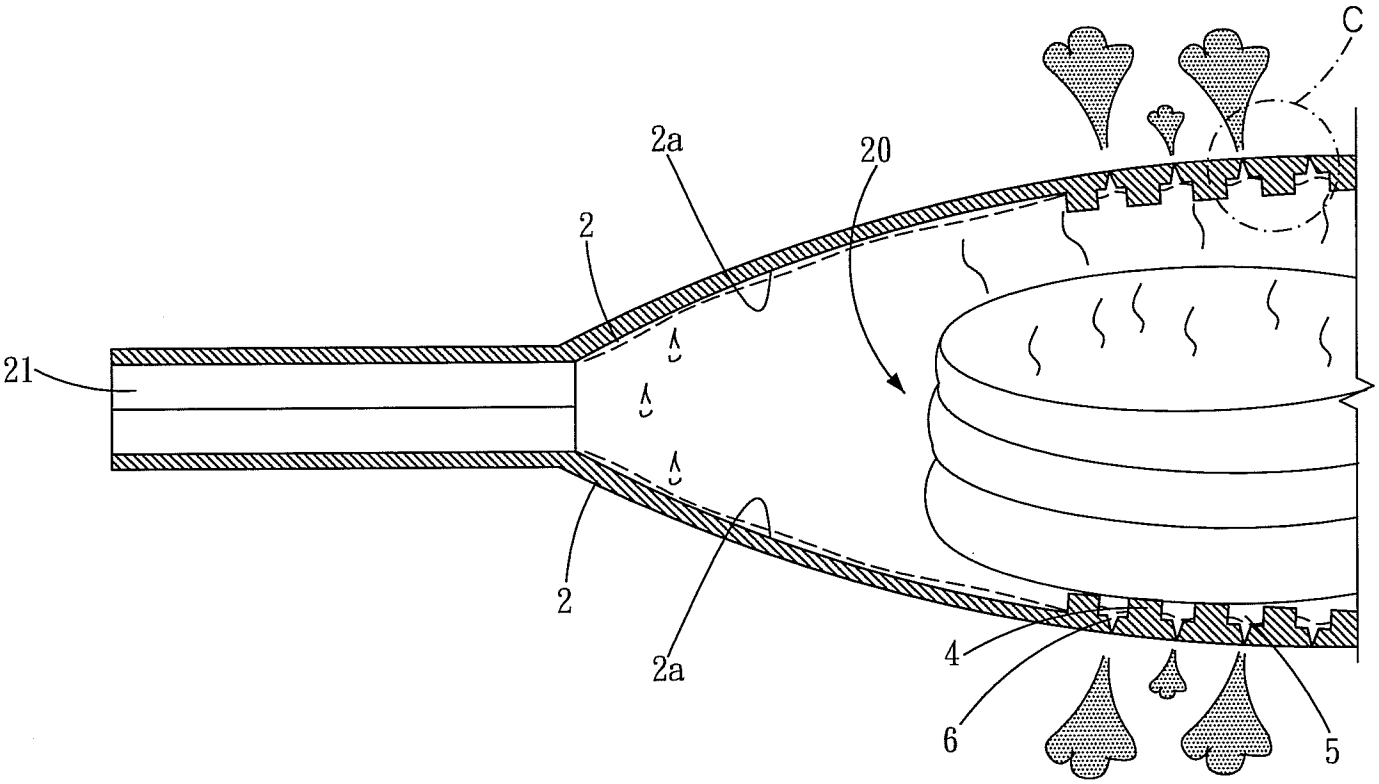
FIG. 6 is a laterally cross sectional view of the first embodiment according to the present invention while air is heated to expand.
Figure 7:
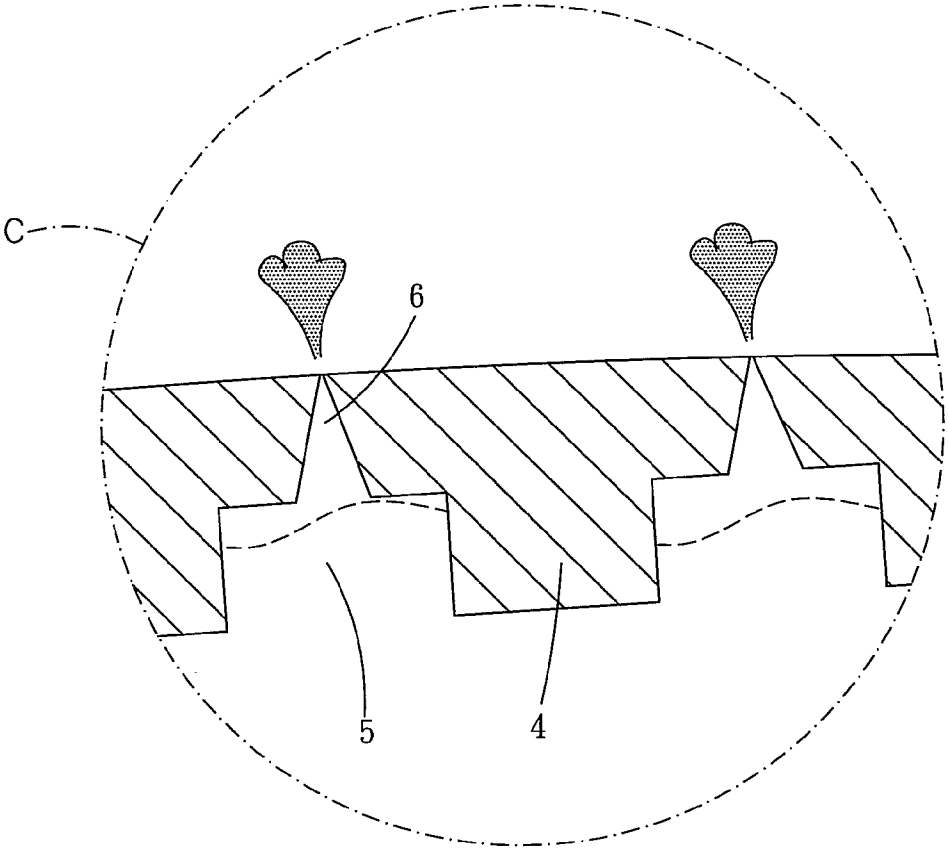
FIG. 7 is a schematically partly enlarged view of a portion C shown in FIG. 6.

FIGS. 1, 2 and 3 schematically a heatable package bag 1 of a first preferred embodiment according to the present invention.

The heatable package bag 1 includes two sheets of outer film 2, a plurality of projections 4, a plurality of guiding channels 5 and a plurality of pre-breakage portions 6.

The two sheets of outer film 2 are stacked together, and the circumferences of the two sheets of outer film 2 are adhered to each other by means of hot sealing to form a bag structure. The two sheets of film 2 respectively have an inner surface 2*a* opposite to each other, a storage space 20 is formed between the plurality of face-to-face inner surfaces 2*a*, and one end of the storage space 20 has an opening 21. The two sheets of outer film 2 can be made from a hot-meltable hot-sealing material such as polyester, ethylene propylene copolymer, ethylene styrene copolymer (ES), cycio olefin, Polyethylene terephthalate (PET), Polyvinyl alcohol (PVA), ethylene vinyle acetate (EVA), polyethylene naphthalate (PEN), Polypropene (PP), nylon, ionomer, biodegradable materials, Polyether ether ketone (PEEK), polycarbonate (PC), Polyimide (PI), Peroxyacetyl nitrate (PAN), Acrylonitrile styrene copolymer (SAN), polyurethane (PU), glassine paper or polymer coated paper; however, these are exemplary and explanatory only, the present invention is not limited to them.

The plurality of projections 4 are disposed on the plurality of inner surfaces 2*a*, and projected our of the plurality of inner surfaces 2*a*, where the plurality of projections 4 are formed integrally on the plurality of inner surfaces 2*a* by adhering the two sheets of inner film 2 by means of hot sealing; but, the way of integrating the plurality of projections 4 with the plurality of inner surfaces 2*a* is explanatory only, the plurality of projections 4 may also be independent elements that are positioned on the plurality of inner surfaces 2*a* by way of adhering or other fixations. Furthermore, the plurality of projections 4 may be distributed completely on the plurality of inner surfaces 2*a*, or only distributed partly on the plurality of inner surfaces 2*a* depending on a practical structure requirement.

The plurality of guiding channels 5 are positioned among the plurality of projections 4 of the plurality of inner surfaces 2*a*, where the plurality of guiding channels 5 are respectively arranged on the plurality of inner surfaces 2*a* in a first direction and a second direction which are intersected with each other, where the included angle of the first and second directions may be a right angle or obtuse angle depending on a practical structure requirement. In addition, the plurality of guiding channels 5 may be arranged simultaneously on the inner surfaces 2*a* of one of the two sheets of outer film 2 in the first and second directions, and the plurality of guiding channels 5 on the inner surface 2*a* of another outer film 2 are arranged similarly. Otherwise, the plurality of guiding channels 5 may be arranged on one of the inner surface 2*a* of one of the two sheets of outer film 2 in the first direction, and on the inner surface 2*a* of another outer film 2 in the second direction. Furthermore, at least one part of the plurality of guiding channels 5 may be arranged parallel to one another. However, the arrangement of the plurality of guiding channels 5 mentioned above is exemplary only; the present invention is not limited to them.

The plurality of pre-breakable portions 6 are positioned on the plurality of guiding channels 5 of the plurality of inner surfaces 2*a*, where the places of the two sheets of outer film 2 on which the plurality of pre-breakage portions 6 are disposed are thinner than other places. As a result, micro-holes will be yielded at the pre-breakage portion 6 when the two sheets of outer film 2 are pressed and the pressure exceeds a critical tensile strength that they can endure.

In the present embodiment, electrical shock is exerted on the plurality of guiding channels 5 of the inner surface 2*a* by a shock generator (e.g. ultrasonic shock generator), to form a concave and convex surface on the inner surface 2*a*; the places exerted by the ultrasonic electrical shock are thinner concave portions, forming the pre-breakage portions 6, and the projections 4 are not exerted by the electrical shock and do not become thinner in comparison with the pre-breakage portions 6 such that they are higher than the pre-breakage portions 6. In other words, the places of the outer film 2 on which the projections 4 are positioned are thicker than the places of the outer film 2 on which the pre-breakage portions 6 are positioned. Furthermore, the plurality of thinner pre-breakage portions 6 may be formed on the inner surface 2*a* by exerting electrical shock on the inner surface 2*a* through a shock generator (e.g. Ultrasonic shock generator), the inner surface 2*a* is then hot-pressed by means of hot sealing to form the plurality of projections 4, and the plurality of guiding channels 5 are formed among the plurality of projections 4, where the pre-breakage portion 6 positioned on the projection 4 is hot-pressed, filled and leveled up and wiped out finally, so only the plurality of pre-breakage portions 6 positioned on the plurality of guiding channels 5 are left over.

In addition to the description mentioned previously, a method for forming the plurality of pre-breakage portions may also use such as a concentric circle die extrusion injection process to obtain cylindrical pull bag style of blow bag, a tenter for stretching, or extrusion injection, and may perform a film stretching process at a temperature lower than or close to a material softening point. However, the methods for forming the plurality of pre-breakage portions 6 mentioned previously are exemplary and explanatory only, the present invention is not limited to these.

Please refer to FIGS. 4, 5, 6 and 7, in which an article 9 is placed in the storage space 20 via the opening 21, the plurality of projections 4 are used to support the surface of the article 9, allowing the article 9 not to attach closely to the inner surface 2*a* of the outer film 2. Subsequently, a suction device or vacuum pump is used to draw the air out of the storage space 20; the air in the storage space 20 may flow to the outside along the plurality of guiding channels 5. Finally, the two sheets of outer film 2 at the opening 21 are adhered together by means of hot sealing, thereby sealing the storage space 20.

A user may use a microwave oven, high temperature steam, water boiling or infrared heating to heat the article 9. The article 9 is at a lower temperature and the vapor pressure in the storage space 20 is smaller during the initial heating, the overwhelming part of microwave energy is converted to heat energy through the vibration and friction of the molecules of the sealed article 9, and since the plurality of projections 4 support the surface of the article 9 to prevent it from attaching closely to the inner surface 2*a*, the article 9 can be heated uniformly effectively. Furthermore, the plurality of guiding channels 5 can guide the air to flow along them during the heating. As a result, the heating effect can be increased. The temperature and the vapor pressure in the storage space 20 are increased when the heating time is longer, the air in the storage space 20 expands outward to compress the two sheets of outer film 2, the plurality of pre-breakage portions 6 are also deformed and expanded as well, becoming thinner gradually and even broken. At this time, the broken pre-breakage portion 6 provides ventilation, and acts as a safety relief valve when the internal air pressure in the storage space 20 is too great, thereby avoiding instant bursting such as happens to a conventional airtight sealed bag due to extreme hot vapor pressure during heating.

Furthermore, since the plurality of pre-breakage portions 6 are configured on the plurality of guiding channels 5 according to the present invention, the guiding channel 5 guiding air flow is not hindered and the effect of breaking the pre-breakage portion 6 is not influenced even if the two sheets of outer film 2 cover the article 9 tightly, because the article 9 is supported by the plurality of projections 4 without contacting with the plurality of guiding channels 5. Wherein the cross-sectional shape of each of the plurality of pre-breakage portions is of V shape.

A method for making a heatable package bag includes:

step 101: providing two sheets of outer film 2 including a plurality of inner surfaces 2*a;* step 102: spot-hitting at least one inner surface 2*a* to form a plurality of pre-breakage portions 6;

step 103: adhering the two sheets of outer film 2 together by means of hot sealing to form a plurality of projections 4 on at least one inner surface 2*a*, and form a plurality of guiding channels 5;

The two sheets of outer film 2 are adhered to each other by means of hot sealing to form the plurality of projections 4 on at least one inner surface 2*a*, and the plurality of guiding channels 5 among the plurality of projections 4, where the plurality of pre-breakage portions 6 positioned on the plurality of projections 4 are hot-pressed to wipe out.

step 104: adhering circumferences of the two sheets of outer film 2 together by means of hot sealing to form a storage space 20 among the plurality of inner surfaces 2*a*.

The storage space 20 is formed among the plurality of face-to-face inner surfaces 2*a*, where one end of the storage space 20 has an opening 21 through which a user can place the article 9 into the storage space 20. Subsequently, the storage space 20 is sealed to close the bag structure. The air in the storage space 20 is expanded during heating to compress the two sheets of outer film 2, breaking the plurality of pre-breakage portions 6 to allow the air to flow out of the storage space 20 via the plurality of pre-breakage portions 6. As regards the method for making a heatable package bag, other descriptions are the same as the contents mentioned previously; these are omitted here.

Another method for making a heatable package bag is different from the method mentioned previously as the followings: first, adhering two sheets of outer film 2 together by means of hot sealing to form a plurality of projections 4 on at least one inner surface 2*a* and a plurality of guiding channels 5, and spot-hitting at least one inner surface 2*a* to form a plurality of pre-breakage portions 6 on the plurality of guiding channels 5, other descriptions are the same as the contents mentioned previously; these are omitted here.

Figure 8:
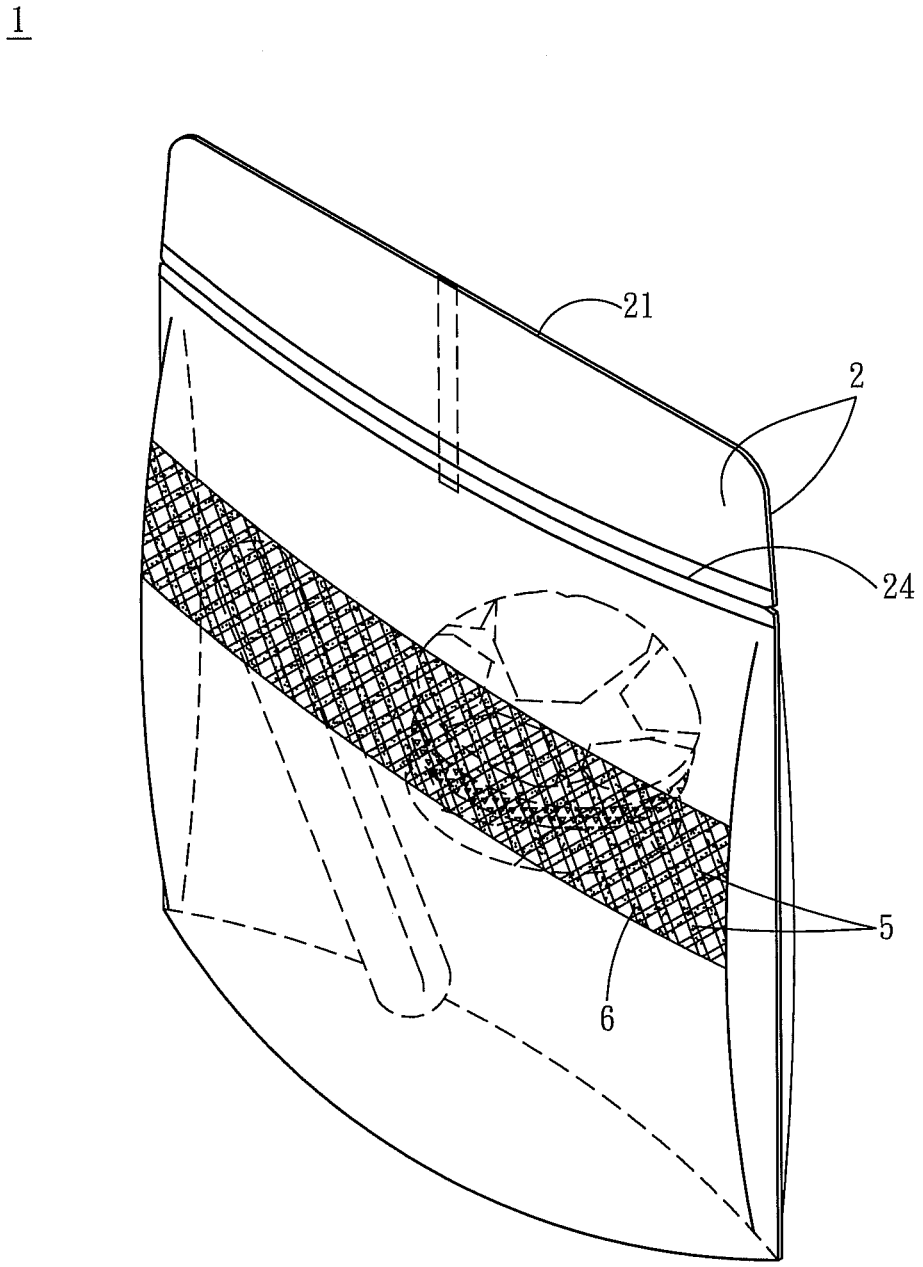
FIG. 8 is a schematically perspective view of a second preferred embodiment according to the present invention.

Please refer to FIG. 8, in which a heatable package bag of a second preferred embodiment is disclosed. The biggest difference between the present embodiment and the first embodiment is a sealing structure at the opening 21 of the storage space 20. In the present embodiment, a open-close element 24 such as clip chain, zipper or other clip chain set with a pair of openable and closable male and female elements, used for closing or opening the storage space 20, convenient for a user to insert or remove the article 9.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A heatable package bag, comprising:

two sheets of outer film, comprising a plurality of inner surfaces; the two sheets of outer film being adhered together by means of hot sealing to form a storage space among the plurality of inner surfaces; adapted to receive an article;

a plurality of projections, positioned on at least one of the plurality of inner surfaces, adapted to support a surface of the article;

a plurality of guiding channels, each guiding channel formed between any two adjacent projections, air in the storage space flowing along the plurality of guiding channels; and a plurality of pre-breakage portions, positioned within the bottom of the plurality of guiding channels, after the storage space is sealed, the air in the storage space being expanded outward to compress the two sheets of outer film during heating, and at least one of the plurality of pre-breakage portions being broken to form a micro-hole, allowing the air to flow out of the storage space via the plurality of pre-breakage portions, wherein the cross-sectional shape of each of the plurality of pre-breakage portions is of a V-shape, wherein the thickness of the two sheets of outer film is smallest at the plurality of pre-breakage portions, wherein each guiding channel of the plurality of guiding channels is communicatively coupled with each other guiding channel of the plurality of guiding channels, and wherein the inner surface of the pluralities of guiding channels is non-planar.

2. A bag, comprising:

a first film sheet; and a second film sheet coupled with the first film sheet, the second film sheet comprising:

an inner surface facing the first film sheet;

an outer surface opposite the inner surface, the second film sheet having a first thickness in a first direction extending from the inner surface to the outer surface;

a plurality of projections extending away from the inner surface toward the first film sheet, the projections of the plurality of projections defining a plurality of channels between the projections of the plurality of projections and the inner surface;

a plurality of sidewalls between the projections of the plurality of projections, extending from the inner surface toward the outer surface; and a plurality of pre-breakage portions between the projections of the plurality of projections, each pre-breakage portion of the plurality of pre-breakage portions comprising a region of the second film sheet having a variable thickness in the first direction between at least one sidewall of the plurality of sidewalls and the outer surface, the variable thickness gradually decreasing from the first thickness to a second thickness as a distance along the at least one sidewall away from the inner surface increases, wherein the first film sheet and the second film sheet are configured to be sealed with a medium trapped between the first film sheet and the second film sheet, and each channel of the plurality of channels is communicatively coupled with each other channel of the plurality of channels the second film sheet is configured to break in at least one of the pre-breakage portions to form at least one micro-hole in the at least one pre-breakage portion of the second film sheet based on an increase in pressure between the first film sheet and the second film sheet caused by an expansion of the medium between the first film sheet and the second film if the first film sheet and the second film sheet are sealed.

3. The bag according to claim 2, wherein the second film sheet is configured to break in the at least one pre-breakage portion to form the at least one micro-hole if the pressure between the first film sheet and the second film sheet exceeds a threshold value.

4. The bag according to claim 3, wherein the first film sheet and the second film sheet are configured to be heated; the expansion of the medium is caused, at least in part, by the heating of the first film sheet and the second film sheet, and the second film sheet is configured to relieve the pressure via the at least one micro-hole.

5. The hag according to claim 2, wherein the second film sheet is configured to allow at least some of the medium to escape through the at least one micro-hole to reduce the pressure between the first film sheet and the second film sheet.

6. The bag according to claim 2, wherein the first film sheet and the second film sheet are configured to accommodate an article between the first film sheet and the second film sheet, the article, if accommodated between the first film sheet and the second film sheet, one or more of displaces or comprises at least some of the medium, and the channels of the plurality of channels are configured to facilitate flow of the medium between the projections of the plurality of projections, the inner surface and the article if the article is accommodated between the first film sheet and the second film sheet and the article is at least partially overlapping the inner surface between two adjacent projections of the plurality of projections.

7. The bag according to claim 6, wherein the first film sheet and the second film sheet are configured to be coupled having a storage space between the first film sheet and the second film sheet configured to receive the article, the storage space being defined by the inner surface, the projections of the plurality of projections, the sidewalls of the plurality of sidewalls, and the first film sheet.

8. The bag according to claim 6, wherein the inner surface of the second film sheet is a first inner surface, the projections of the plurality of projections are first projections, the channels of the plurality of channels are first channels, and the first film sheet comprises:

a second inner surface facing the second film sheet; and a plurality of second projections extending away from the second inner surface toward the second film sheet, the second projections of the plurality of second projections defining a plurality of second channels between the second projections of the plurality of second projections and the second inner surface, wherein at least the first projections of the plurality of first projections or the second projections of the plurality of second projections are configured to support at least a portion of the article if the article is between the first film sheet and the second film sheet.

9. The bag according to claim 8, wherein the outer surface of the second film sheet is a first outer surface, the sidewalls of the plurality of sidewalls are first sidewalls, the pre-breakage portions of the plurality of pre-breakage portions are first pre-breakage portions, the at least one micro-hole is a first micro-hole, and the first film sheet further comprises:

a second outer surface opposite the second inner surface, the first film sheet having a third thickness in a second direction extending from the second inner surface to the second outer surface;

a plurality of second sidewalls between the second projections of the plurality of second projections, extending from the second inner surface toward the second outer surface; and a plurality of second pre-breakage portions between the second projections of the plurality of second projections, each second pre-breakage portion of the plurality of second pre-breakage portions comprising a region of the first film sheet having a variable thickness in the second direction between at least one second sidewall of the plurality of second sidewalk and the second outer surface, the variable thickness gradually decreasing from the third thickness to a fourth thickness as a distance along the at least one second sidewall away from the second inner surface increases, wherein the first film sheet is configured to break in at least one of the second pre-breakage portions to form at least one second micro-hole in the at least one second pre-breakage portion of the first film sheet based on the increase in pressure between the first film sheet and the second film sheet caused by the expansion of the medium between the first film sheet and the second film if the first film sheet and the second film sheet are sealed.

10. The bag according to claim 2, wherein a first group of projections of the plurality of projections are linearly aligned, a second group of projections of the plurality of projections are linearly aligned in a direction parallel to the alignment of the first group of projections, and a group of pre-breakage portions of the plurality of pre-breakage portions are linearly aligned between the first group of projections and the second group of projections.

11. The bag according to claim 10, wherein the second film sheet is free from having pre-breakage portions between the projections of the plurality of projections in at least one channel of the plurality of channels extending in a direction perpendicular to the alignment of the first group of projections.

12. The bag according to claim 11, wherein the each pre-breakage portion of the group of pre-breakage portions is linearly aligned with a projection of the first group of projections and with a projection of the second group of projections in a direction parallel to the at least one channel of the plurality of channels.

13. The bag according to claim 2, wherein the second film sheet is a single-layer film sheet.

14. The bag according to claim 2, wherein the second film sheet is a multi-layer film sheet comprising a first layer and a second layer, the first layer includes the inner surface, the outer surface, and the sidewalk of the plurality of sidewalls, and the second layer included the projections of the plurality of projections.

15. The bag according to claim 2, wherein the second film sheet is coupled with the first film sheet by a heat sealed portion such that the first film sheet and the second film sheet are configured to be oriented to form a storage space between the first film sheet and the second film sheet configured to receive an article to be accommodated between the first film sheet and the second film sheet.

16. The bag according to claim 2, wherein the first film sheet and the second film sheet are configured to be sealed by way of one or more of a hot sealed portion, a clip chain, a zipper, or corresponding male and female elements.

17. The bag according to claim 2, wherein the second film sheet has a minimum thickness in at least one pre-breakage portion of the plurality of pre-breakage portions, and the minimum thickness is at a distance away from the inner surface along at least one sidewall of the plurality of.

18. The bag according to claim 2, wherein a cross-section of the second film sheet through at least one pre-breakage portion of the plurality of pre-breakage portions is V-shaped.

19. The bag according to claim 2, wherein the outer surface is free from having projections, holes or through holes in at least a region opposite the projections of the plurality of projections and opposite the pre-breakage portions of the plurality of pre-breakage portions in a state before the at least one micro-hole is formed.

20. The bag according to claim 2, wherein the inner surface has a first surface area, a region of the first film sheet within which the projections of the plurality of projections are positioned has a second surface area, and the second surface area is less than the first surface area.

* * * * *